US008132407B2

(12) United States Patent
Li et al.

(10) Patent No.: US 8,132,407 B2
(45) Date of Patent: Mar. 13, 2012

(54) MODULAR EXHAUST GAS RECIRCULATION COOLING FOR INTERNAL COMBUSTION ENGINES

(75) Inventors: Xiaobin (Sharon) Li, Livonia, MI (US); Sherif H. El Tahry, Troy, MI (US); Fabien G. Redon, Southfield, MI (US)

(73) Assignee: GM Global Technology Operations LLC

( * ) Notice: Subject to any disclaimer, the term of this patent is extended or adjusted under 35 U.S.C. 154(b) by 862 days.

(21) Appl. No.: 12/062,210

(22) Filed: Apr. 3, 2008

(65) Prior Publication Data

US 2009/0249782 A1 Oct. 8, 2009

(51) Int. Cl.
*F02B 33/44* (2006.01)
*F02B 29/04* (2006.01)
*F02M 25/07* (2006.01)

(52) U.S. Cl. ..... 60/605.2; 60/599; 123/568.11; 123/568.12

(58) Field of Classification Search ..... 60/605.2, 60/599, 612; 123/568.12, 568.11, 568.22; *F02M 25/07; F02B 29/04*
See application file for complete search history.

(56) References Cited

U.S. PATENT DOCUMENTS

| | | | | |
|---|---|---|---|---|
| 5,607,010 | A * | 3/1997 | Schonfeld et al. | 60/605.2 |
| 6,141,961 | A * | 11/2000 | Rinckel | 60/288 |
| 7,032,577 | B2 * | 4/2006 | Rosin et al. | 123/568.12 |
| 7,168,419 | B2 * | 1/2007 | Rosin et al. | 123/568.12 |
| 7,222,615 | B2 * | 5/2007 | Buck et al. | 60/605.2 |
| 7,284,544 | B2 * | 10/2007 | Hatano | 123/568.12 |
| 7,469,181 | B2 * | 12/2008 | Duffy et al. | 60/605.2 |
| 7,469,691 | B2 * | 12/2008 | Joergl et al. | 60/605.2 |
| 7,621,128 | B2 * | 11/2009 | Czarnowski et al. | 60/605.2 |
| 7,661,415 | B2 * | 2/2010 | Nakamura | 60/605.2 |
| 2006/0288694 | A1 * | 12/2006 | Hayashi | 60/298 |
| 2007/0017489 | A1 * | 1/2007 | Kuroki et al. | 123/568.12 |
| 2007/0089400 | A1 * | 4/2007 | Huang | 123/568.12 |
| 2007/0157893 | A1 * | 7/2007 | Wei et al. | 123/568.12 |
| 2007/0163258 | A1 * | 7/2007 | Narita et al. | 60/612 |
| 2008/0163855 | A1 * | 7/2008 | Matthews et al. | 60/605.2 |
| 2008/0178853 | A1 * | 7/2008 | Yamaoka et al. | 123/568.11 |
| 2008/0190108 | A1 * | 8/2008 | Eitel et al. | 60/605.2 |
| 2008/0196679 | A1 * | 8/2008 | Irmler et al. | 123/41.49 |
| 2009/0025698 | A1 * | 1/2009 | Reuss et al. | 123/568.12 |
| 2009/0044789 | A1 * | 2/2009 | Eitel et al. | 123/568.12 |
| 2009/0101122 | A1 * | 4/2009 | Kurtz et al. | 123/568.12 |
| 2009/0188475 | A1 * | 7/2009 | Ueda | 123/568.12 |
| 2009/0260605 | A1 * | 10/2009 | Janssen et al. | 123/568.12 |
| 2010/0095939 | A1 * | 4/2010 | Geskes | 123/568.12 |
| 2010/0101226 | A1 * | 4/2010 | Shutty et al. | 123/568.11 |

FOREIGN PATENT DOCUMENTS

JP 2006037765 A * 2/2006

(Continued)

*Primary Examiner* — Thai Ba Trieu
(74) *Attorney, Agent, or Firm* — Harness, Dickey & Pierce, P.L.C.

(57) ABSTRACT

An EGR system compensates for differing EGR flows and/or exhaust temperatures and can maintain the cooler exit temperature above the critical temperature, thereby reducing the possibility of EGR cooler fouling. A plurality of exhaust gas recirculation cooler modules is disposed between an exhaust gas passage and an air passage. The cooler modules receive exhaust gas from the exhaust gas passage and supply the received exhaust gas to the air passage for recirculation into an intake manifold. Each of the cooler modules includes a cooler portion, a bypass portion, and a flow control device. The cooler portion and the bypass portion are arranged such that fluid flowing through the cooler portion and the bypass portion flows therethrough without flowing through the other of the cooler portion and the bypass portion. The cooler portion reduces a temperature of the fluid flowing through the cooler portion.

14 Claims, 4 Drawing Sheets

FOREIGN PATENT DOCUMENTS

| | | | | |
|---|---|---|---|---|
| JP | 2006037773 | A | * | 2/2006 |
| JP | 2007315323 | A | * | 12/2007 |
| JP | 2009270476 | A | * | 11/2009 |
| WO | WO 03085252 | A2 | * | 10/2003 |
| WO | WO 2005108756 | A1 | * | 11/2005 |
| WO | WO 2006122306 | A2 | * | 11/2006 |
| WO | WO 2006136372 | A1 | * | 12/2006 |
| WO | WO 2008118660 | A1 | * | 10/2008 |

* cited by examiner

MODULAR EXHAUST GAS RECIRCULATION COOLING FOR INTERNAL COMBUSTION ENGINES

FIELD

The present disclosure relates to internal combustion engines and, more particularly, to cooling the exhaust gas recirculation flow of internal combustion engines.

BACKGROUND

The statements in this section merely provide background information related to the present disclosure and may not constitute prior art.

Internal combustion engine operation involves combustion that generates exhaust gas. During combustion, air is delivered through an intake valve and fuel is delivered through a fuel injector and mixes in the cylinder. The mixture is combusted therein. Air flow delivered to these cylinders can be measured using a mass air flow (MAF) sensor. The MAF sensor measures the total intake of fresh air flow through the air induction system, which may include one or more turbochargers. After combustion, the piston forces exhaust gas in these cylinders into an exhaust system. The exhaust gas may contain various emission components, including unburned hydrocarbons and particulates or soot.

Engine systems often include an exhaust gas recirculation (EGR) system to reduce engine emissions. EGR involves re-circulating exhaust gases back into the cylinders, which reduces the amount of oxygen available for combustion and lowers cylinder temperatures. An EGR system can enable ignition timing to remain at an optimum point, which improves fuel economy and/or performance. However, fouling of one or more components of the EGR system can occur if the temperature of the exhaust gas drops below a critical level. In particular, heavy hydrocarbons in the exhaust flow can condense and the soot particles therein can conglomerate and stick to the surface of the components.

The exhaust recirculation gas mixes with incoming air supplied to the intake manifold. The exhaust recirculation gas can thereby increase the temperature of the air flowing into the intake manifold. As the temperature of the air flowing into the intake manifold increases, an increase in the pressure of the flow is required to achieve the same mass flow rate of air to the intake manifold. As a result, the higher temperature can result in pumping losses and require the turbocharger to work harder. In extreme cases, if the pressure exceeds the capabilities of the turbocharger, a desired quantity of exhaust recirculation gas flow may not be possible thereby reducing the benefits to the emissions of the EGR system.

Typically, a single EGR cooler is utilized to meet the cooling requirements of the EGR system. Currently the EGR cooler is designed to meet the maximum EGR cooling required by an engine, usually at the highest EGR flow and high exhaust temperature. As a result, when the engine operates at lower EGR flow and/or lower exhaust temperature, the EGR cooler capacity exceeds the required level. This can cause the cooler exit temperature to drop below the critical temperature, thereby causing EGR cooler fouling. In an attempt to compensate for this, some EGR coolers have a bypass wherein the exhaust recirculation gas bypasses the cooler and, as a result, does not have its temperature reduced. When using a bypass, the exhaust recirculation gas may be at an undesirably high temperature. Thus, during some operating conditions the typical EGR system currently utilized either provides potentially overcompensation for the cooling of the exhaust recirculation gas or no cooling.

SUMMARY

An EGR system according to the present teachings compensates for differing EGR flows and/or exhaust temperatures and can maintain the cooler exit temperature above the critical temperature and reduce the possibility of EGR cooler fouling.

The EGR system can include an exhaust gas passage that receives exhaust gases discharged by an engine. There is an air passage communicating with an intake manifold and supplying air to the intake manifold. A plurality of exhaust gas recirculation cooler modules is disposed between the exhaust gas passage and the air passage. The cooler modules receive exhaust gas from the exhaust gas passage and supply the received exhaust gas to the air passage for recirculation into the intake manifold. Each of the cooler modules includes an inlet, an outlet, a cooler portion, a bypass portion, and a flow control device. The cooler portion and the bypass portion each communicate with the inlet and outlet and are arranged such that fluid flowing through the cooler portion and the bypass portion flows therethrough without flowing through the other of the cooler portion and bypass portion. The cooler portion cools fluid flowing therethrough.

In another aspect according to the present teachings, the EGR system is utilized in an engine system having an engine with cylinders therein. The cylinders are operable to combust air and fuel. The intake manifold communicates with the engine cylinders and with the air passage that supplies air to the intake manifold. An exhaust manifold communicates with the engine cylinders and with an exhaust passage that receives exhaust gases discharged by the cylinders.

In another aspect of the present teachings, a method of cooling an exhaust recirculation gas flow with a plurality of exhaust cooler modules each having a cooler portion and a bypass portion is disclosed. The method includes routing a portion of an exhaust gas flow into an exhaust gas recirculation passage. Heat is selectively removed from the exhaust gas flowing through the exhaust gas recirculation passage with the plurality of exhaust cooler modules disposed in the exhaust gas recirculation passage and through which the exhaust gas flows. Exhaust gas is selectively supplied from the exhaust recirculation passage to an air intake passage.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
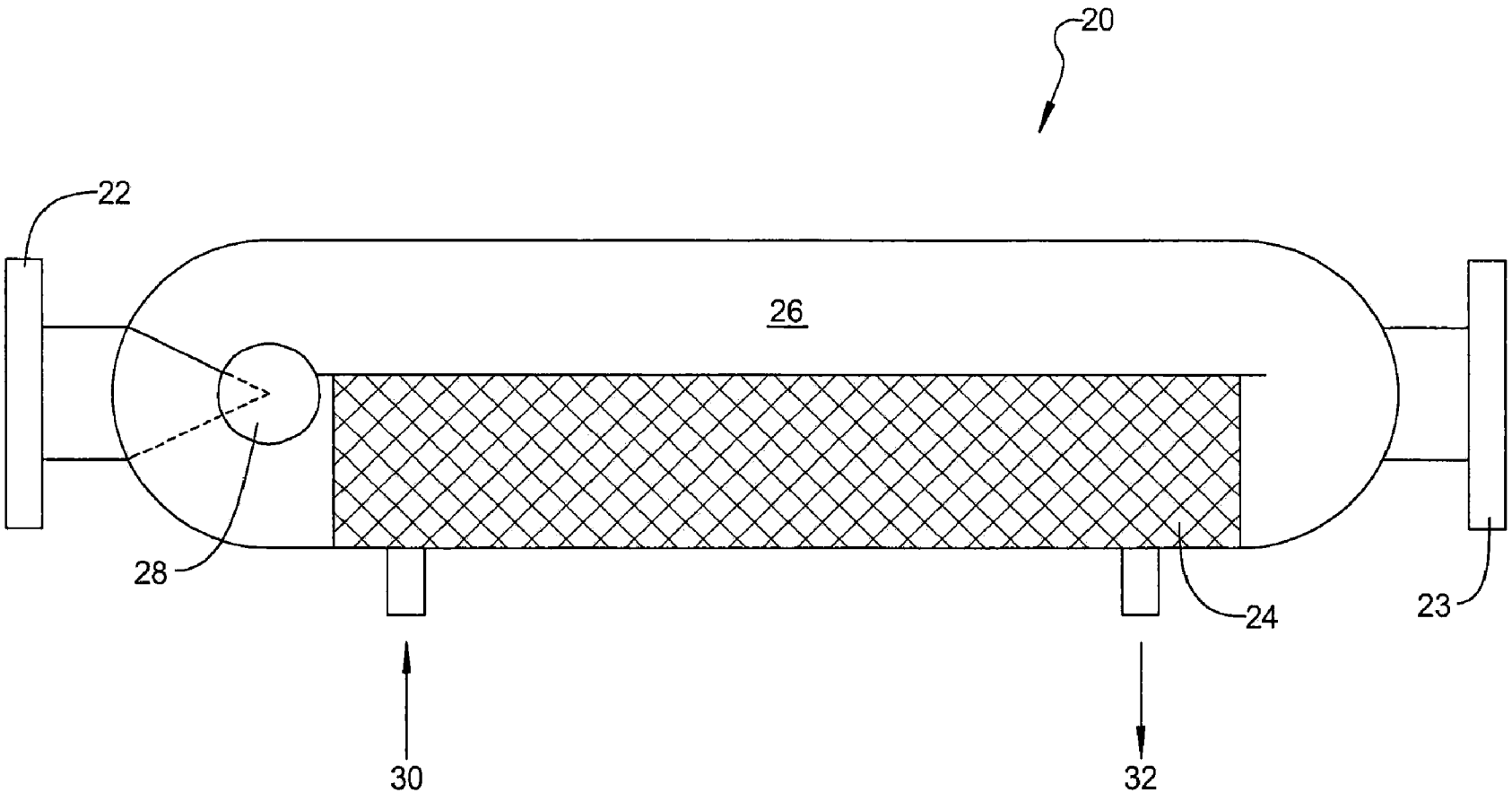
FIG. 1 is a simplified schematic representation of an EGR cooling module according to the present teachings.

The following description is merely exemplary in nature and is not intended to limit the present teachings, application, or uses. It should be understood that throughout the drawings, corresponding reference numerals indicate like or corresponding parts and features and are indicated with indices that are indexed by 100 (e.g., 20, 120, 220, etc.).

According to the present teachings, an exhaust gas recirculation (EGR) system utilizes multiple EGR cooler modules 20 to provide varying levels of cooling, as needed, to the exhaust recirculation gas. FIG. 1 shows an exemplary EGR cooler module 20 that can be utilized with the EGR cooling systems of the present teachings. EGR cooler module 20 includes an inlet 22 and an outlet 23 through which exhaust recirculation gas enters and exits EGR cooler module 20. EGR cooler module includes a cooler core 24 and a bypass passage 26 through which the exhaust recirculation gas can flow. A flow control device 28, such as a valve, can be disposed within EGR cooler module 20 and direct the flow of exhaust recirculation gas to either cooler core 24 or bypass passage 26. Flow control device 28 can be adjacent inlet 22, as shown, or adjacent outlet 23. Flow control device 28 can be a simple on/off device wherein all of the exhaust recirculation gas flows through one of cooler core 24 or bypass passage 26.

Cooler core 24 includes an inlet 30 and outlet 32 through which coolant can enter into and exit cooler core 24. Exhaust recirculation gas flowing through cooler core 24 is in heat-transferring relation with the coolant flowing through cooler core 24. The exhaust recirculation gas and the coolant do not intermix. The heat transfer to the coolant flowing through cooler core 24 reduces the temperature of the exhaust recirculation gas flowing through cooler core 24.

When the exhaust recirculation gas flows through bypass passage 26, the temperature of the exhaust recirculation gas may not be changed by any significant amount. Flow control device 28 can be responsive to signals provided thereto, such as by a control module by way of non-limiting example. Flow control device 28 can have a default position, such as directing the exhaust recirculation gas through cooler core 24 or through bypass passage 26, in the absence of a signal indicating a desired non-default position. As a result, EGR cooler module 20 can direct the exhaust recirculation gas flowing therethrough either through cooler core 24 or bypass passage 26 to provide a desired exit temperature for the exhaust recirculation gas exiting the EGR cooler module 20.

Figure 2:
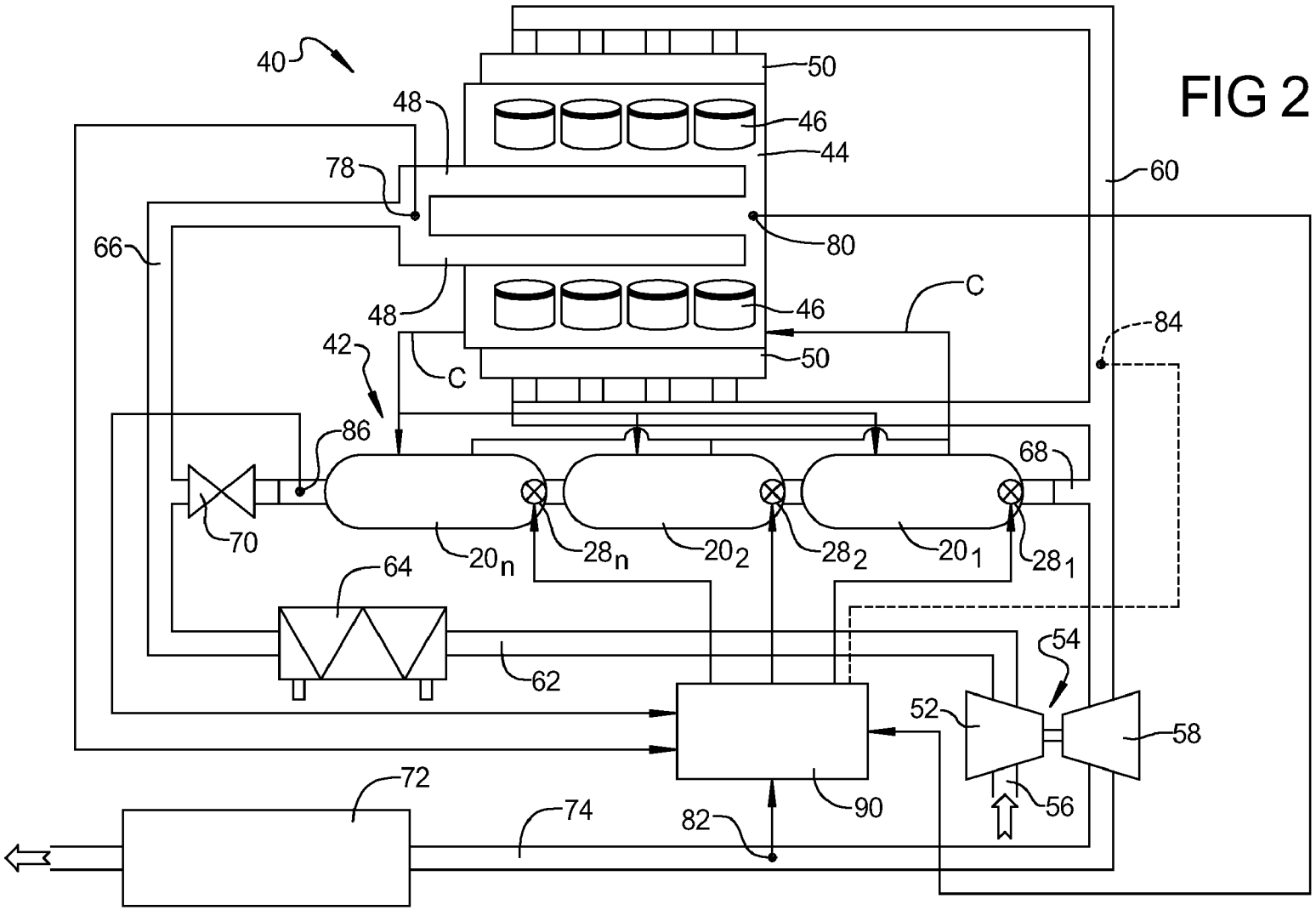
FIG. 2 is a schematic representation of an internal combustion engine system incorporating a first EGR system for cooling the exhaust recirculation gas according to the present teachings.

Referring now to FIG. 2, a schematic representation of an internal combustion engine system 40 that utilizes a first EGR system 42 according to the present teachings is shown. Engine system 40 can be a gasoline or diesel engine system by way of non-limiting example. Engine system 40 includes an engine 44 having a plurality of cylinders 46 that communicate with an intake manifold 48 and an exhaust manifold(s) 50. Engine 44 also receives fuel (not shown). Engine 44 combusts air from intake manifold 48 and the fuel within cylinders 46 and discharges exhaust gas through exhaust manifold 50. Engine system 40 can use a turbocharger 54. When this is the case, fresh air is supplied to the air side 52 of the turbocharger 54 through a supply passage 56. An exhaust side 58 of turbocharger 54 receives exhaust gas flow from exhaust manifolds 50 through an exhaust passage 60. Turbocharger 54 compresses the air flowing through air side 52 which then flows through an air passage 62 to a charge cooler 64. Charge cooler 64 is operable to reduce the temperature of the compressed air flowing therethrough. Charge cooler 64 can be an air-air cooler or a liquid-air cooler. When charge cooler 64 is a liquid-air cooler, coolant or other liquid can flow through charge cooler 64 to extract heat from the compressed air flowing therethrough. Cooled air from charge cooler 64 is supplied to intake manifold 48 through air passage 66.

Engine system 40 includes EGR system 42. A recirculation system wherein a recirculation passage 68 extends from exhaust passage 60 to air passage 66. A flow control device 70 is operable to selectively allow exhaust gas in recirculation passage 68 to flow into air passage 66 and join with the compressed cooled air flowing therethrough. As a result, exhaust gas can be selectively routed to intake manifold 48 along with compressed cooled air. Thus, a portion of the exhaust gas discharged from cylinders 46 can be re-circulated through intake manifold 48 while the remaining portion of the exhaust gas in exhaust passage 60 flows through exhaust side 58 of turbocharger 54. Exhaust gas exiting turbocharger 54 can flow through emission control devices 72 via exhaust passage 74. Exhaust gas exiting emission control devices 72 may be discharged to the atmosphere.

Engine system 40 can also include a variety of sensors that are operable to supply signals indicative of operating characteristics of engine system 40. For example, engine system 40 can include an intake manifold temperature sensor 78 which can provide a signal indicative of the fluid temperature in intake manifold 48. A coolant temperature sensor 80 can provide a signal indicative of the temperature of the coolant flowing through engine 44 and available to flow through the cooler core of an EGR cooler module 20. An exhaust gas temperature sensor 82 can provide a signal indicative of the temperature of the exhaust gas flowing through exhaust passage 74. Optionally, an exhaust gas temperature sensor 84 can be disposed in exhaust passage 60 to provide a signal indicative of the temperature of the exhaust gas upstream of turbocharger 54, as indicated in phantom in FIG. 2. An exhaust recirculation gas temperature sensor 86 can provide a signal indicative of the temperature of the exhaust recirculation gas that flows into air passage 66.

EGR system 42 includes a plurality of EGR cooler modules $\mathbf{20}_1$-$\mathbf{20}_n$ that are arranged in series in recirculation passage 68. With the series arrangement, all exhaust recirculation gas flows through each EGR cooler module $\mathbf{20}_1$, $\mathbf{20}_2$, $\mathbf{20}_n$ prior to joining with the air flow in air passage 66. The exhaust recirculation gas flowing through each EGR cooler module $\mathbf{20}_1$, $\mathbf{20}_2$, $\mathbf{20}_n$ can flow either through the associated cooler core or bypass passage, depending upon the operational state of the associated flow control device $\mathbf{28}_1$, $\mathbf{28}_2$, $\mathbf{28}_n$. Flow control devices $\mathbf{28}_1$, $\mathbf{28}_2$, $\mathbf{28}_n$ can be selectively operated to provide a desired level of cooling for the exhaust recirculation gas. In this manner, a desired temperature of the exhaust recirculation gas can be achieved, as described below. The engine 44 includes a cooling system having a coolant (C) flowing therethrough. The coolant flows through the engine 44 and through the cooler core 24 of the cooler modules 20 via inlets 30 and outlet 32 and removes heat from fluid flowing through the cooler core 24.

A control module 90 can communicate with each EGR cooler module $\mathbf{20}_1$, $\mathbf{20}_2$, $\mathbf{20}_n$ and command desired operation of the associated flow control device $\mathbf{28}_1$, $\mathbf{28}_2$, $\mathbf{28}_n$. Specifically, control module 90 can provide signals to the actuators of flow control devices $\mathbf{28}_1$, $\mathbf{28}_2$, $\mathbf{28}_n$ to command flow control devices $\mathbf{28}_1$, $\mathbf{28}_2$, $\mathbf{28}_n$ to direct the exhaust recirculation gas through either the associated cooler core or bypass passage.

EGR cooler modules $20_1$, $20_2$, $20_n$ can thereby be individually controlled to either cool the exhaust recirculation gas or bypass the exhaust recirculation gas around the associated cooler core.

Control module 90 can adjust the operation of EGR cooler modules $20_1$, $20_2$, $20_n$ based upon operating conditions of engine system 40. Control module 90 can receive signals from temperature sensors 78, 80, 82, 84, and 86 that can be used to provide the appropriate command signals to EGR cooler modules $20_1$, $20_2$, $20_n$ to achieve a desired cooling for the exhaust recirculation gas.

Control module 90 can control EGR cooler modules $20_1$, $20_2$, $20_n$ based on a variety of desired operating conditions for engine system 40 and the components of EGR system 42. During the operation of engine system 40, the temperature of the exhaust gas can be in the range of about 100° C. to about 150° C. during light load conditions, while under high load conditions the temperature of the exhaust gas can be about 750° C., by way of non-limiting example. Thus, the exhaust gas temperature can vary greatly, depending upon the load placed on engine 44. The exhaust recirculation gas can contain heavy hydrocarbons and soot particles. As a result, if the temperature of the exhaust recirculation gas drops below a critical temperature $T_c$, the heavy hydrocarbons may condense and facilitate the conglomeration of soot particles in the components of EGR system 42. As a result, it is desirable to maintain the temperature of the exhaust recirculation gas $T_{erg}>T_c$. By way of non-limiting example, the critical temperature $T_c$ can be in the range of about 120° C. to about 200° C. Thus, it can be desirable to maintain the temperature of the exhaust recirculation gas $T_{erg}>T_c$. Additionally, the further $T_{erg}$ is above $T_c$, the likelihood of the conglomeration of soot particles and fouling of the components decreases.

While it is desirable to avoid operation that can promote the conglomeration of soot and possible fouling, the needs of engine system 40 must also be taken into account and balanced with the needs of EGR system 42. For example, it can be desirable to maintain the intake manifold temperature less than a maximum value. The maximum value can be based upon a variety of factors, such as the emission control systems utilized in engine system 40, the ability to supply fresh air to the intake manifold, the physical properties of the intake manifold, etc., as will be appreciated by one skilled in the art.

Another consideration that can influence the operation of EGR system 42 is the requirements of emission control devices 72. For example, the emission control devices 72 may require that the exhaust gas temperature be greater than a minimum temperature to function. If the exhaust gas temperature is too low, it may be desirable to reduce the cooling provided by EGR system 42 to increase the temperature of the intake manifold, thereby increasing the exhaust gas temperature.

Another consideration is the temperature of the coolant that is available to cool the exhaust recirculation gas. In some cases, the coolant temperature may be low and result in excessive cooling of the exhaust recirculation gas. For example, during a cold startup, the coolant temperature may be at ambient and, as a result, the EGR cooler module will have a greater reduction in temperature of the exhaust recirculation gas. This may be undesirable as the exhaust recirculation gas may drop below the critical temperature $T_c$. Thus, it may be desirable to bypass the cooling capabilities of the EGR cooler modules when the coolant temperature is below a minimum.

Accordingly, the operation of EGR system 42 can be based upon various operating conditions of engine system 40. It should be appreciated that the factors discussed above are merely exemplary in nature and that other operating parameters and considerations can be utilized to adjust the operation of EGR system 42. Regardless of the parameters and considerations utilized to control EGR system 42, the use of multiple EGR cooler modules $20_1$, $20_2$, $20_n$ enables the various factors to be considered and improved performance achieved, as described below.

Figure 3:
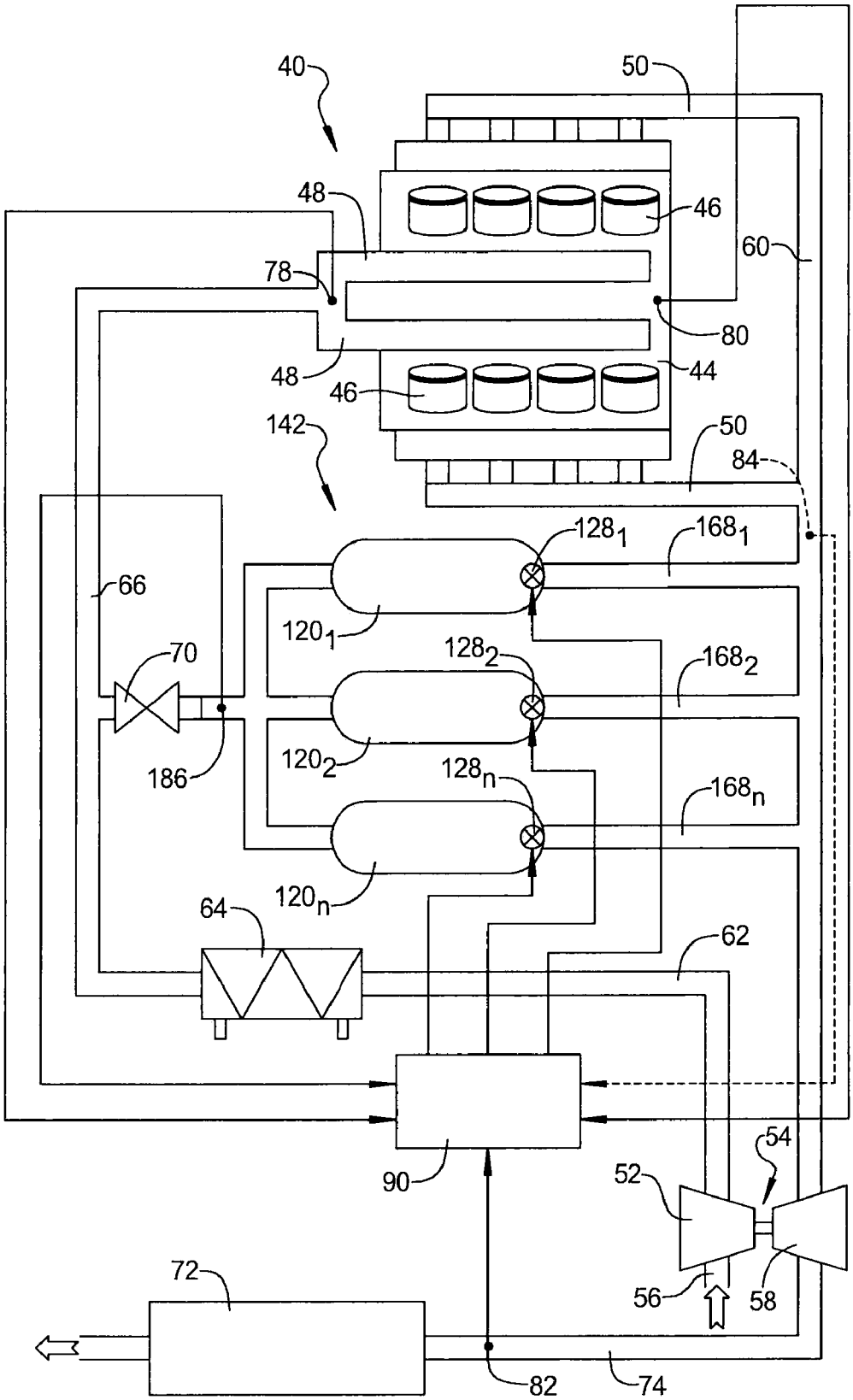
FIG. 3 is a schematic representation of an internal combustion engine system incorporating a second EGR system for cooling the exhaust recirculation gas according to the present teachings.

Referring now to FIG. 3, a second embodiment of an EGR system 142 according to the present teachings is schematically shown installed in engine system 40. In this embodiment, EGR cooler modules $120_1$, $120_2$, $120_n$ are arranged in parallel with one another and each receive separate exhaust recirculation gas flows through recirculation passages $168_1$, $168_2$ and $168_n$. Exhaust recirculation gas exiting each EGR cooler module $120_1$, $120_2$, $120_n$ join together prior to flowing through flow control device 70 and joining with the airflow in air passage 66.

In the parallel arrangement, the exhaust recirculation gas would generally follow the path of least resistance. Thus, the particular quantity of exhaust recirculation gas flowing through recirculation passages $168_1$, $168_2$, $168_n$ may vary based upon whether the associated EGR cooler module $120_1$, $120_2$, $120_n$ is directing the exhaust recirculation gas flowing therethrough through either the cooler core or bypass passage. The relative differences in the exhaust recirculation gas flows can be influenced by a difference in the flow restriction between the cooler core and the bypass passage for EGR cooler modules $120_1$, $120_2$, $120_n$.

To control the relative flow rates to each EGR cooler module $120_1$, $120_2$, $120_n$, it may be desirable to put variable restriction devices in recirculation passages $168_1$, $168_2$, $168_n$ to control the flow resistance such that desired flow rates through the different coolers can occur, such as a relatively same rate of flow through each EGR cooler module $120_1$, $120_2$, $120_n$. It should be appreciated, however, that this would increase the complexity of EGR system 142 and also the control algorithms utilized to control the operation of same.

Thus, in EGR system 142, the various EGR cooler modules $120_1$, $120_2$, $120_n$ can be selectively operated independently of one another to provide a desired cooling to the exhaust recirculation gas. Control module 90 can adjust the operation of the flow control devices $128_1$, $128_2$, $128_n$ to selectively cause each EGR cooler module $120_1$, $120_2$, $120_n$ to either cool the exhaust recirculation gas by directing it through its associated cooler core or by allowing the exhaust recirculation gas to not be cooled by directing it through its associated bypass passage. EGR system 142 can be operated in a similar manner to that discussed above with reference to EGR system 42. Accordingly, further discussion of operation of EGR system 142 is not provided.

Figure 4:
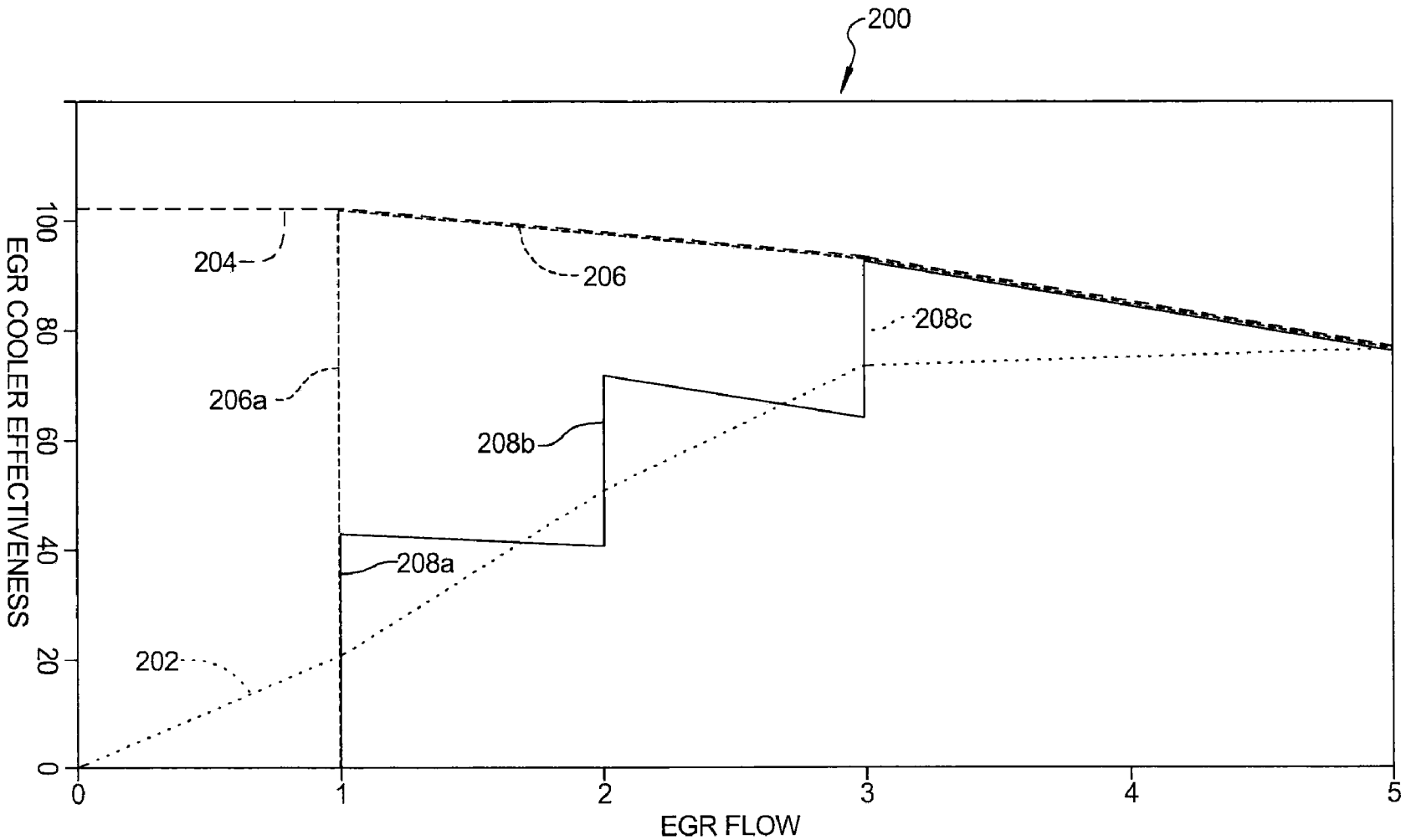
FIG. 4 is a graph illustrating the theoretical benefits of the EGR system for exhaust recirculation gas cooling according to the present teachings compared to other EGR systems.

Referring now to FIG. 4, a theoretical graph of EGR cooler effectiveness as a function of the exhaust gas recirculation flow rate is shown. Graph 200 is a theoretical graph and does not reflect actual test data. In graph 200, the exhaust recirculation gas flow is indicated from 0-5, with 5 being the maximum flow and 0 being no flow. The exhaust recirculation gas flow is along the horizontal axis. The EGR cooler effectiveness, as shown in the vertical axis, goes from 0-100%. The effectiveness is a comparison of the temperature of the exhaust recirculation gas exiting the cooler as a percentage of the temperature of the coolant that flows through the cooler. Thus, a 100% effectiveness means that the exhaust recirculation gas temperature exiting the cooler is essentially the same as the temperature of the coolant, thereby indicating an effectiveness of 100%.

The cooling needs of the exhaust recirculation gas can increase as the flow rate of the exhaust recirculation gas increases and as the temperature of the exhaust gas discharged from the engine increases. In graph 200, line 202 represents a desired effectiveness of the cooling of the exhaust recirculation gas. As can be seen, as the flow rate of the exhaust recirculation gas increases, the desired effectiveness for the cooler also increases as greater cooling is required to accommodate the larger flow and, possibly, the higher exhaust temperature due to a higher load placed on the engine. Line 202 also represents a desired balance between minimizing the potential for fouling the EGR components with the preferred operation of the engine system.

Line 204 represents the effectiveness of an EGR system wherein a single EGR cooler is utilized without any bypass capability. As can be seen, at low flow rates of the exhaust recirculation gas, the effectiveness is at or near the 100% level. This is due to the cooler being oversized (to accommodate the maximum cooling needs) and all gas flow therethrough being cooled to the temperature of the coolant. However, this may cause the temperature of the exhaust recirculation gas to drop below the critical temperature and can thereby promote the conglomeration of soot particles and the fouling of components of the EGR system. As the flow rate of the exhaust recirculation gas increases, the cooling needs also increase such that curve 204 can approach the desired curve 202 at some point in time. The area under curve 204 is significantly greater than the area under curve 202. This difference in area represents excess cooling capacity, which is not required to cool the exhaust recirculation gas. Additionally, this excess capacity can result in adverse operating conditions, such as an exhaust recirculation gas temperature below the critical temperature, as described above.

Curve 206 represents the same single EGR cooler with the addition of a single bypass. The single cooler is again designed to meet the maximum cooling needs of the exhaust recirculation gas. The use of a bypass, however, enables the onset of cooling of the exhaust recirculation gas to be delayed until certain operating conditions occur, such as a particular exhaust recirculation gas flow rate, temperature, or the like. It should be appreciated, however, that at some point the bypass needs to be turned off and the cooler utilized to cool the exhaust recirculation gas. In the example shown in graph 200, the bypass is utilized while the exhaust recirculation gas flows between 0 and 1. When the exhaust recirculation gas is 1 and larger, the bypass is no longer used and the single EGR cooler is used to cool the exhaust recirculation gas.

As a result, curve 206 has a vertical component 206*a* when the exhaust recirculation gas flow is 1. The exact point at which the bypass is no longer used and cooling begins can be based on a variety of factors, such as a tradeoff between the desire to provide a lower exhaust recirculation gas temperature for proper engine performance and a desire to maintain the exhaust recirculation gas temperature above the critical temperature to avoid the conglomeration of soot and possible fouling of the components. Due to the tradeoff involved, when there is no cooling, the exhaust recirculation gas temperature may be higher than desired and when the cooling begins there will be over-capacity and the effectiveness can approach 100%. The difference between curve 206 and curve 202 represents excess capacity wherein excess cooling occurs. As the flow rate of the exhaust recirculation gas increases, the effectiveness begins to drop and approaches that of the desired curve 202 at some increased flow rate. As a result of the overcooling, the temperature of the exhaust recirculation gas can be lower than the critical temperature or lower than a desired temperature. As a result, the effectiveness of the EGR system may be reduced and fouling may occur.

According to the present teachings, multiple EGR cooler modules 20 can be employed to more closely match the desired effectiveness of the cooling of the exhaust recirculation gas. The use of multiple EGR cooler modules 20 can enable each EGR cooler module 20 to have a lower cooling capacity and they can be brought on-line as the cooling needs of the exhaust recirculation gas increase. In graph 200, curve 208 represents a potential result of utilizing a plurality of EGR cooler modules 20 according to the present teachings. As each EGR cooler module 20 comes on-line, the ability to cool the exhaust recirculation gas increases and this increased capability results in step changes in curve 208, indicated as 208*a*, 208*b*, 208*c*. As the flow rate of the exhaust recirculation gas increases, additional EGR cooler modules 20 are brought on-line. For example, in graph 200, a first EGR cooler module 20 is brought on-line when the flow of the exhaust recirculation gas is 1. When the flow rate increases to 2, a second EGR cooler module 20 is brought on-line and, likewise, when the flow rate increases to 3, a third EGR cooler module 20 is brought on-line. As can be seen, when each EGR cooler module 20 is brought on-line, there is some excess cooling capacity realized as represented by the area between curves 208 and 202. However, the overall area under curve 208 more closely approximates the area under curve 202. Thus, the use of a plurality of smaller EGR cooler modules 20 that can be brought on-line as the cooling needs of the exhaust recirculation gas increases can result in a closer approximation to a desired effectiveness.

Due to the closer approximation to the desired curve 202, an EGR system 42, 142 according to the present teachings can be more efficient and more closely meet the cooling needs of the exhaust recirculation gas. This capability reduces the tradeoffs required between maintaining the exhaust recirculation gas above the critical temperature and the desired intake and exhaust gas temperature. Thus, an EGR system 42, 142 according to the present teachings can provide improved cooling of the exhaust recirculation gas while reducing the tradeoffs that must occur between the competing requirements in the operation of an engine system 40 incorporating an EGR system 42, 142.

It should be appreciated that curve 208 represents the use of three EGR cooler modules 20, according to the present teachings. If additional EGR cooler modules 20 were employed, curve 208 could more closely approximate the desired curve 202. However, as the number of EGR cooler modules 20 increases, the cost of the system may also increase. Thus, as a result, when designing an EGR system 42, 142, the cost of the increased number of EGR cooler modules 20 can be balanced against the increased benefits of more closely approximating desired curve 202.

A control algorithm can be utilized for operation of an EGR system 42, 142 according to the present teachings. At the beginning of operation, control monitors the operating conditions and determines whether a cold start condition is occurring. A cold start can be ascertained by monitoring the coolant temperature. If a cold start is detected, all EGR cooler modules 20, 120 are operated in a bypass condition. Control continues to evaluate if a cold start condition exists and bypasses all EGR cooler modules 20, 120 until the cold start condition is no longer present.

When a cold start condition is no longer present, control determines if the engine is running. If the engine is no longer running, control ends. If the engine is running, control ascertains if cooling is needed. If cooling is not needed, control continues to monitor the operating conditions and performs an iterative process.

When cooling is needed, control brings at least one EGR cooler module 20, 120 on-line. The number of EGR cooler modules 20, 120 brought on-line can vary based upon the operating conditions.

Control then ascertains if additional cooling is needed. If more cooling is needed, control ascertains if additional cooling capacity is available. If additional cooling capacity is available, control brings additional EGR cooler modules 20, 120 on-line.

Control continues to ascertain if more cooling is needed, if more EGR cooler modules 20, 220 are available, and brings additional EGR cooler modules 20, 220 on-line until either no additional cooling is needed or there are no other EGR cooler modules 20, 220 available, at which time control ascertains if less cooling is needed. If less cooling is not needed, control returns to ascertain if more cooling is needed. If less cooling is needed, control reduces the number of EGR cooler modules 20, 220 that are on-line and returns to monitoring the operating status.

Thus, control can adjust the operation of the EGR cooler modules 20, 120 to provide a desired cooling for the exhaust recirculation gas. It should be appreciated that the preceding control is merely exemplary and that other steps and/or considerations can be employed in the operation of an EGR system 42, 142 according to the present teachings.

The use of EGR cooler modules 20, 120 can advantageously facilitate the cooling of the exhaust recirculation gas. The number of EGR cooler modules 20, 120 can be selected to provide the desired cooling effectiveness. The use of smaller EGR cooler modules 20, 120 can facilitate the use of the EGR cooler modules 20, 120 in a variety of vehicles employing a variety of engine systems. For example, different engine systems may have differing cooling needs. As a result, the number of EGR cooler modules 20, 120 according to present teachings can be selected to meet the particular application. The use of EGR cooler modules 20, 120 can therefore allow a desired EGR system 42, 142 to be employed in a variety of systems by merely changing the number of EGR cooler modules 20, 120 utilized. This capability can facilitate the design of systems for various engines and vehicles along with reducing the number of different parts or components for different vehicles produced by a manufacturer. The use of EGR cooler modules 20, 120 can also facilitate repair and maintenance of the vehicles by providing commonality among different vehicles with different engine systems through the ability to replace one or more EGR cooler modules 20, 120, as needed, with the same part regardless of the vehicle or engine system in which it is employed. Currently, EGR cooler modules 20, 120 according to present teachings can advantageously reduce the cost of providing EGR systems 42, 142 across a variety of engine systems, vehicles and/or applications. Additionally, the use of the EGR cooler modules 20, 120 according to the present teachings can also advantageously allow the coolant effectiveness to more closely approximate the desired effectiveness with the ability to further approach the desired effectiveness through the use of additional EGR cooler modules 20, 120.

While the preceding description has been made with reference to specific examples and illustrations, it should be appreciated that changes can be made without departing from the spirit and scope of the present teachings. For example, the number and arrangement of the EGR cooler modules 20, 120 can vary from that shown. Additionally, the EGR cooler modules 20, 120 can include a proportioning flow control device and can be operated so that simultaneous flow occurs through both the associated cooler core and the bypass passage, although all of the benefits of the present teachings may not be realized. The proportioning can be discrete (i.e., set positions) or infinite (i.e., unlimited number of positions). Additionally, the flow of coolant through the EGR cooler modules 20, 120 can be regulated to provide greater control over the cooling capacity of each EGR cooler module 20, 120, although all of the benefits of the present teachings may not be realized. Additionally, while control module 90 is shown as being a stand-alone control module 90, it should be appreciated that the control module 90 could be part of the control module utilized to control the engine system within which the EGR system 42, 142 is employed. Additionally, the control module 90 could be one component of a larger control module. Thus, changes and deviations can be made to the illustrations and examples shown herein without departing from the spirit and scope of the present teachings.

What is claimed is:

1. A method of cooling an exhaust recirculation gas flow with a plurality of exhaust cooler modules each having a cooler portion and a bypass portion, the method comprising:

routing a portion of an exhaust gas flow in a region of an engine exhaust gas passage being located in an engine exhaust gas flow path between an engine exhaust manifold and an exhaust side of a turbocharger into an exhaust gas recirculation passage;

routing some of the exhaust gas in the gas recirculation passage through each one of the plurality of exhaust gas cooler modules, the plurality of cooler modules being disposed in the exhaust gas recirculation passage and arranged in series in the exhaust gas recirculation passage such that all fluid flowing through the exhaust gas recirculation passage flows through every cooler module inlets of the plurality of exhaust gas cooler modules being in communication with the first region of the engine exhaust selectively removing heat from the exhaust gas flow flowing through the exhaust gas recirculation passage with at least two of the plurality of exhaust gas cooler modules disposed in the exhaust gas recirculation passage and through which the exhaust gas flows; and selectively supplying exhaust gas from the exhaust recirculation passage to an air intake passage.

2. The method of claim 1, wherein selectively removing heat includes routing the exhaust gas flow through either the bypass portion or the cooler portion in each of the cooler modules.

3. The method of claim 2, wherein selectively removing heat includes actively adjusting the cooler modules to change whether the exhaust gas flowing therethrough flows through the bypass portion or the cooler portion.

4. The method of claim 3, further comprising monitoring an air intake temperature, an exhaust gas temperature upstream of the cooler modules, and an exhaust gas temperature downstream of the cooler modules and wherein actively adjusting the cooler modules includes actively adjusting the cooler modules based on one or more of the monitored temperatures.

5. A modular exhaust gas recirculation system comprising:

an exhaust gas passage receiving exhaust gases discharged by an engine;

an air passage adapted to communicate with and supply air to an intake manifold;

an exhaust gas recirculation passage extending between the exhaust gas passage and the air passage; and a plurality of exhaust gas recirculation cooler modules disposed between the exhaust gas passage and the air passage, the cooler modules receiving exhaust gas from the exhaust gas passage and supplying received exhaust gas to the air passage, the plurality of cooler modules being disposed in the exhaust gas recirculation passage and arranged in series in the exhaust gas recirculation passage such that all fluid flowing through the exhaust gas recirculation passage flows through every cooler module, wherein each of the cooler modules includes an inlet in communication with a region of the engine exhaust gas passage being located in an engine exhaust gas flow path between an engine exhaust manifold and an exhaust side of a turbocharger, an outlet, a cooler portion, a bypass portion, and a flow control device, the cooler portion and the bypass portion each communicating with the inlet and outlet and arranged such that fluid flowing through the cooler portion and the bypass portion flows therethrough without flowing through the other of the cooler portion and the bypass portion, and the cooler portion reducing a temperature of fluid flowing through the cooler portion.

6. The modular exhaust gas recirculation system of claim 1, further comprising a flow control device in the exhaust gas recirculation passage operable to selectively allow flow through the exhaust gas recirculation passage.

7. The modular exhaust gas recirculation system of claim 1, further comprising a control module selectively operating the flow control devices in the cooler modules to direct fluid flowing therethrough into either the associated bypass portion or the associated cooler portion.

8. The modular exhaust gas recirculation system of claim 7, further comprising a plurality of sensors providing signals to the control module indicative of operating conditions and wherein the control module adjusts the flow control devices based on the signals.

9. The modular exhaust gas recirculation system of claim 8, wherein the sensors provide signals indicative of an intake air temperature, an exhaust gas temperature, and a temperature of fluid flowing through the exhaust gas recirculation passage downstream of at least one of the cooler modules.

10. An engine system comprising:

an engine having cylinders therein operable to combust air and a fuel;

an air intake manifold communicating with the engine cylinders;

an exhaust manifold communicating with the engine cylinders;

an exhaust gas passage communicating with the exhaust manifold and receiving exhaust gases discharged by the cylinders;

an air passage communicating with the intake manifold and supplying air to the intake manifold;

an exhaust gas recirculation passage extending between the exhaust gas passage and the air passage; and a plurality of exhaust gas recirculation cooler modules disposed between the exhaust gas passage and the air passage, the cooler modules receiving exhaust gas from the exhaust gas passage and supplying received exhaust gas to the air passage for recirculation into the intake manifold, the plurality of cooler modules being disposed in the exhaust gas recirculation passage and arranged in series in the exhaust gas recirculation passage such that all fluid flowing through the exhaust gas recirculation passage flows through every cooler module, wherein each of the cooler modules includes an inlet in communication with a region of the engine exhaust gas passage being located in an engine exhaust gas flow path between the engine exhaust manifold and an exhaust side of a turbocharger, an outlet, a cooler portion, a bypass portion, and a flow control device, the cooler portion and the bypass portion each communicating with the inlet and outlet and arranged such that fluid flowing through the cooler portion and the bypass portion flows therethrough without flowing through the other of the cooler portion and the bypass portion, the cooler portion reducing a temperature of fluid flowing through the cooler portion.

11. The engine system of claim 10, further comprising a control module selectively operating the flow control devices in the cooler modules to direct fluid flowing therethrough into either the associated bypass portion or the associated cooler portion.

12. The engine system of claim 11, further comprising a plurality of sensors providing signals to the control module indicative of operating conditionsof the engine system and wherein the control module adjusts the flow control devices based on the signals.

13. The engine system of claim 12, wherein the sensors provide signals indicative of an intake air temperature, an exhaust gas temperature, and a temperature of fluid flowing through the exhaust gas recirculation passage downstream of at least one of the cooler modules.

14. The engine system of claim 10, further comprising a cooling system having a coolant flowing therethrough, the coolant flowing through the engine and through the cooler portions of the cooler modules and removing heat from fluid flowing through the cooler portions.

* * * * *